US011466509B2

(12) United States Patent
Zhang et al.

(10) Patent No.: US 11,466,509 B2
(45) Date of Patent: Oct. 11, 2022

(54) SPLIT IRON FRAME DOOR STRUCTURE

(71) Applicant: Ningbo Tengyu Metal Product Co., Ltd., Ningbo (CN)

(72) Inventors: Peike Zhang, Ningbo (CN); Junhua Jiang, Ningbo (CN); Yechen Xu, Ningbo (CN); Zhewei Wu, Ningbo (CN); Lei Ying, Ningbo (CN)

(73) Assignee: Ningbo Tengyu Metal Product Co., Ltd., Ningbo (CN)

( * ) Notice: Subject to any disclaimer, the term of this patent is extended or adjusted under 35 U.S.C. 154(b) by 0 days.

(21) Appl. No.: 17/341,618

(22) Filed: Jun. 8, 2021

(65) Prior Publication Data

US 2022/0065030 A1 Mar. 3, 2022

(30) Foreign Application Priority Data

Apr. 9, 2020 (CN) ..... 202020513352.8

(51) Int. Cl.

| | |
|---|---|
| ***E06B 3/72*** | (2006.01) |
| ***E06B 3/46*** | (2006.01) |
| ***E06B 3/70*** | (2006.01) |
| ***E04B 2/74*** | (2006.01) |
| *E06B 3/58* | (2006.01) |

(52) U.S. Cl.

CPC ..... *E06B 3/72* (2013.01); *E04B 2/7455* (2013.01); *E06B 3/4636* (2013.01); *E06B 3/7003* (2013.01); *E06B 3/5892* (2013.01); *E06B 2003/7011* (2013.01); *E06B 2003/7074* (2013.01)

(58) Field of Classification Search

CPC ..... E06B 3/72; E06B 3/4636; E06B 3/5892; E06B 2003/7011; E06B 2003/7074; E06B 3/7003; E04B 2/745; E04B 2/7455

USPC .... 52/204.71, 204.6, 204.595, 204.593, 457, 52/456, 458

See application file for complete search history.

(56) References Cited

U.S. PATENT DOCUMENTS

| | | | | |
|---|---|---|---|---|
| 1,177,605 A * | 4/1916 | Dipple | ..... | E06B 3/5892 52/204.68 |
| 2,980,217 A * | 4/1961 | Etling | ..... | E06B 3/728 52/656.2 |
| 2,996,161 A * | 8/1961 | Etling | ..... | E06B 3/726 52/656.7 |

(Continued)

*Primary Examiner* — Brent W Herring

(74) *Attorney, Agent, or Firm* — HEA Law PLLC; Darrin A. Auito

(57) ABSTRACT

There provides a split iron frame door structure including top, middle and bottom split frames. A top edge frame and two first side edge frames of the top split frame, two second side edge frames of the middle split frame, and a bottom edge frame and two third side edge frames of the bottom split frame are thin-wall square tubes. Transversely-arranged first and fourth flat-iron edge frames are fixed to the bottom of the top split frame and the top of the bottom split frame, respectively. Transversely-arranged second and third flat-iron edge frames are fixed to the top and the bottom of the middle split frame, respectively. The first and second flat-iron edge frames are detachably connected through a first I-shaped section material and first connecting screws. The third and fourth flat-iron edge frames are detachably connected through a second I-shaped section material and second connecting screws.

8 Claims, 14 Drawing Sheets

(56) References Cited

U.S. PATENT DOCUMENTS

| | | | | |
|---|---|---|---|---|
| 4,013,371 | A * | 3/1977 | Nagase | E06B 3/9636 403/336 |
| 5,105,597 | A * | 4/1992 | Wilkening | E06B 3/72 52/455 |
| 5,704,182 | A * | 1/1998 | Schiedegger | E06B 9/04 52/762 |
| 7,228,662 | B1 * | 6/2007 | John | E06B 3/962 52/212 |
| 7,624,553 | B2 * | 12/2009 | Dries | E05B 1/0015 52/784.1 |
| 2006/0016144 | A1 * | 1/2006 | Jacobs | E06B 3/9647 52/455 |
| 2007/0119112 | A1 * | 5/2007 | Goodman | E06B 5/003 52/455 |
| 2014/0000195 | A1 * | 1/2014 | Daniels | C04B 20/0068 52/784.11 |
| 2016/0102492 | A1 * | 4/2016 | Cai | E06B 3/68 52/204.6 |
| 2017/0247934 | A1 * | 8/2017 | Cai | E06B 3/7001 |
| 2018/0023336 | A1 * | 1/2018 | Groff | E05D 15/063 49/410 |

* cited by examiner

SPLIT IRON FRAME DOOR STRUCTURE

CROSS REFERENCE TO RELATED APPLICATION

This patent application claims the benefit and priority of Chinese Patent Application No. 202020513352.8 filed on Apr. 9, 2020, the disclosure of which is incorporated by reference herein in its entirety as part of the present application.

TECHNICAL FIELD

The disclosure relates to an iron frame door structure, and specifically relates to a split iron frame door structure.

BACKGROUND ART

At present, an iron frame door provided with glass in the market is usually welded and assembled as a whole before leaving a factory, and this iron frame door is packaged wholly when leaving the factory. So, the packaged iron frame door is large in size, the logistics transportation is inconvenient, and the transportation cost is high. In addition, a thickness of the material for the frame of the iron frame door is thick, so that the iron frame door is heavy. And meanwhile, the area of the glass is reduced to a certain extent because the thickness of the material of the frame is thick, thus the iron frame door has the problem that the light transmittance thereof is low.

SUMMARY

The technical problem to be solved by the disclosure is to provide a split iron frame door structure in view of the defects in the prior art. The top split frame, a middle split frame and a bottom split frame of the split iron frame door structure can be individually packaged. So, the packaging cost and the transportation cost are low. Furthermore, the iron frame door structure is light in overall weight, concise in appearance and good in light transmittance.

The technical scheme used to solve the technical problem in the disclosure is as follows. The split iron frame door structure includes a top split frame, a middle split frame and a bottom split frame which are detachably connected in sequence from top to bottom, wherein the top split frame includes two first side edge frames, top glass, and a top edge frame which are connected as a whole; the middle split frame includes two second side edge frames and middle glass which are connected as a whole; the bottom split frame includes two third side edge frames, bottom glass, and a bottom edge frame which are connected as a whole; the top edge frame and the two first side edge frames of the top split frame, the two second side edge frames of the middle split frame and the bottom edge frame and the two third side edge frames of the bottom split frame are thin-wall square tube frames; a bottom of the top split frame is fixed with a transversely-arranged first flat-iron edge frame; a top of the middle split frame is fixed with a transversely-arranged second flat-iron edge frame; a bottom of the middle split frame is fixed with a transversely-arranged third flat-iron edge frame; a top of the bottom split frame is fixed with a transversely-arranged fourth flat-iron edge frame; the first flat-iron edge frame and the second flat-iron edge frame are detachably connected through a first I-shaped section material and a plurality of first connecting screws; the first flat-iron edge frame is embedded in one notch of the first I-shaped section material; the second flat-iron edge frame is embedded in an other notch of the first I-shaped section material; the first flat-iron edge frame, a first middle plate of the first I-shaped section material and the second flat-iron edge frame are fixedly connected in sequence from top to bottom through the first connecting screws; the third flat-iron edge frame and the fourth flat-iron edge frame are detachably connected through a second I-shaped section material and a plurality of second connecting screws; the third flat-iron edge frame is embedded in one notch of the second I-shaped section material; the fourth flat-iron edge frame is embedded in an other notch of the second I-shaped section material; and the third flat-iron edge frame, a second middle plate of the second I-shaped section material and the fourth flat-iron edge frame are fixedly connected in sequence from top to bottom through the second connecting screws.

The split iron frame door structure in the disclosure adopts the split design. The top split frame, the middle split frame and the bottom split frame of the split iron frame door structure can be individually packaged, and can be transported to an installation site and then spliced and installed, so that the packaging cost and the transportation cost can be reduced.

The frames of the top split frame, the middle split frame and the bottom split frame of the split iron frame door structure in the disclosure are made of thin-wall square tubes and the flat iron, so that the thickness of the frames is reduced, the overall weight of the iron frame door is reduced, the appearance of the iron frame door is more concise, and the light transmittance of the iron frame door is improved.

The frames of connecting portions of the middle split frame, the top split frame and the bottom split frame are oriented in a thickness direction through the first I-shaped section material, the first connecting screws, the second I-shaped section material, and the second connecting screws. Furthermore, the first and second I-shaped section materials can shield gaps generated due to insufficient flatness between the split frames after assembling, thereby ensuring the attractive appearance of the iron frame door.

Preferably, the top split frame, the middle split frame, the bottom split frame, the first flat-iron edge frame, the second flat-iron edge frame, the third flat-iron edge frame and the fourth flat-iron edge frame have same widths.

Preferably, the top edge frame and the two first side edge frames of the top split frame as well as the first flat-iron edge frame are each fixed with two first flat-iron division bars, which are arranged at intervals and are configured for embedding and fixing the top glass; the two second side edge frames of the middle split frame, the second flat-iron edge frame and the third flat-iron edge frame are each fixed with two second flat-iron division bars, which are arranged at intervals and configured for embedding and fixing the middle glass; and the bottom edge frame and the two third side edge frames of the bottom split frame as well as the fourth flat-iron edge frame are each fixed with two third flat-iron division bars, which are arranged at intervals and configured for embedding and fixing the bottom glass.

Preferably, the top edge frame of the top split frame is fixedly connected with two trolley plates; a pulley is installed on each of the two trolley plates; the pulley is slidably erected on a guide rail fixed to a wall; one of the two second side edge frames of the middle split frame is installed with a door handle; and the bottom edge frame of the bottom split frame is installed with a swing stopping device. The split iron frame door structure having the above-mentioned structure is applied to the sliding door system.

Preferably, the first I-shaped section material comprises a first section material part, a second section material part and the first middle plate; the first section material part and the second section material part are symmetrically arranged at two ends of the first middle plate; the first middle plate is vertical to the first section material part and the second section material part respectively; the second I-shaped section material comprises a third section material part, a fourth section material part and the second middle plate; the third section material part and the fourth section material part are symmetrically arranged at two ends of the second middle plate; and the second middle plate is vertical to the third section material part and the fourth section material part respectively.

Preferably, the first middle plate comprises a first connecting plate; the first section material part comprises a first bent part, a second bent part and a third bent part which are connected in sequence; the second section material part comprises a fourth bent part, a fifth bent part and a sixth bent part which are connected in sequence; and the first bent part, the second bent part, the third bent part, the first connecting plate, the fourth bent part, the fifth bent part and the sixth bent part are bent in sequence to form the first I-shaped section material; the second middle plate comprises a second connecting plate; the third section material part comprises a seventh bent part, an eighth bent part and a ninth bent part which are connected in sequence; the fourth section material part comprises a tenth bent part, an eleventh bent part and a twelfth bent part which are connected in sequence; and the seventh bent part, the eighth bent part, the ninth bent part, the second connecting plate, the tenth bent part, the eleventh bent part and the twelfth bent part are bent in sequence to form the second I-shaped section material.

Preferably, the first middle plate comprises a first connecting plate and a third connecting plate which are arranged in parallel; the first section material part comprises a first bent part, a second bent part and a third bent part which are connected in sequence; the second section material part comprises a fourth bent part, a fifth bent part and a sixth bent part which are connected in sequence; the first bent part, the second bent part, the third bent part, the first connecting plate, the fourth bent part, the fifth bent part and the sixth bent part are bent in sequence; one end of the third connecting plate is connected with one end of the first bent part; and an other end of the third connecting plate is connected with one end of the sixth bent part; the second middle plate comprises a second connecting plate and a fourth connecting plate which are arranged in parallel; the third section material part comprises a seventh bent part, an eighth bent part and a ninth bent part which are connected in sequence; the fourth section material part comprises a tenth bent part, an eleventh bent part and a twelfth bent part which are connected in sequence; the seventh bent part, the eighth bent part, the ninth bent part, the second connecting plate, the tenth bent part, the eleventh bent part and the twelfth bent part are bent in sequence; one end of the fourth connecting plate is connected with one end of the seventh bent part; and an other end of the fourth connecting plate is connected with one end of the twelfth bent part.

Preferably, the first connecting screws and the second connecting screws are pan head screws with cross recess.

Preferably, the two first flat-iron division bar, the two second flat-iron division bars and the two third flat-iron division bars are bent division bars; each of the bent division bars comprises a first connecting part and a second connecting part; and one end of the first connecting part is vertically arranged at one end of the second connecting part to form an L-shaped structure.

Compared with the prior art, the split iron frame door structure in the disclosure has the advantages as follows. The split iron frame door structure adopts the split design, and the top split frame, the middle split frame and the bottom split frame thereof can be individually packaged, and transported to an installation site and then spliced and installed, so that the packaging cost and the transportation cost can be reduced. The frames of the top split frame, the middle split frame and the bottom split frame of the split iron frame door structure are made of thin-wall square tubes and the flat iron, so that the thickness of the frames is reduced, the overall weight of the iron frame door is reduced, the appearance of the iron frame door is more concise, and the light transmittance of the iron frame door is improved.

BRIEF DESCRIPTION OF THE DRAWINGS

To more clearly illustrate the embodiment of the present disclosure or the technical scheme in the prior art, the following briefly introduces the accompany drawing figures to be used in the embodiment. Apparently, the accompany drawing figures in the following description show merely some embodiments of the present disclosure, and those skilled in the art may still derive other drawings from these attached figures without creative efforts.

REFERENCE SIGNS

Figure 1:
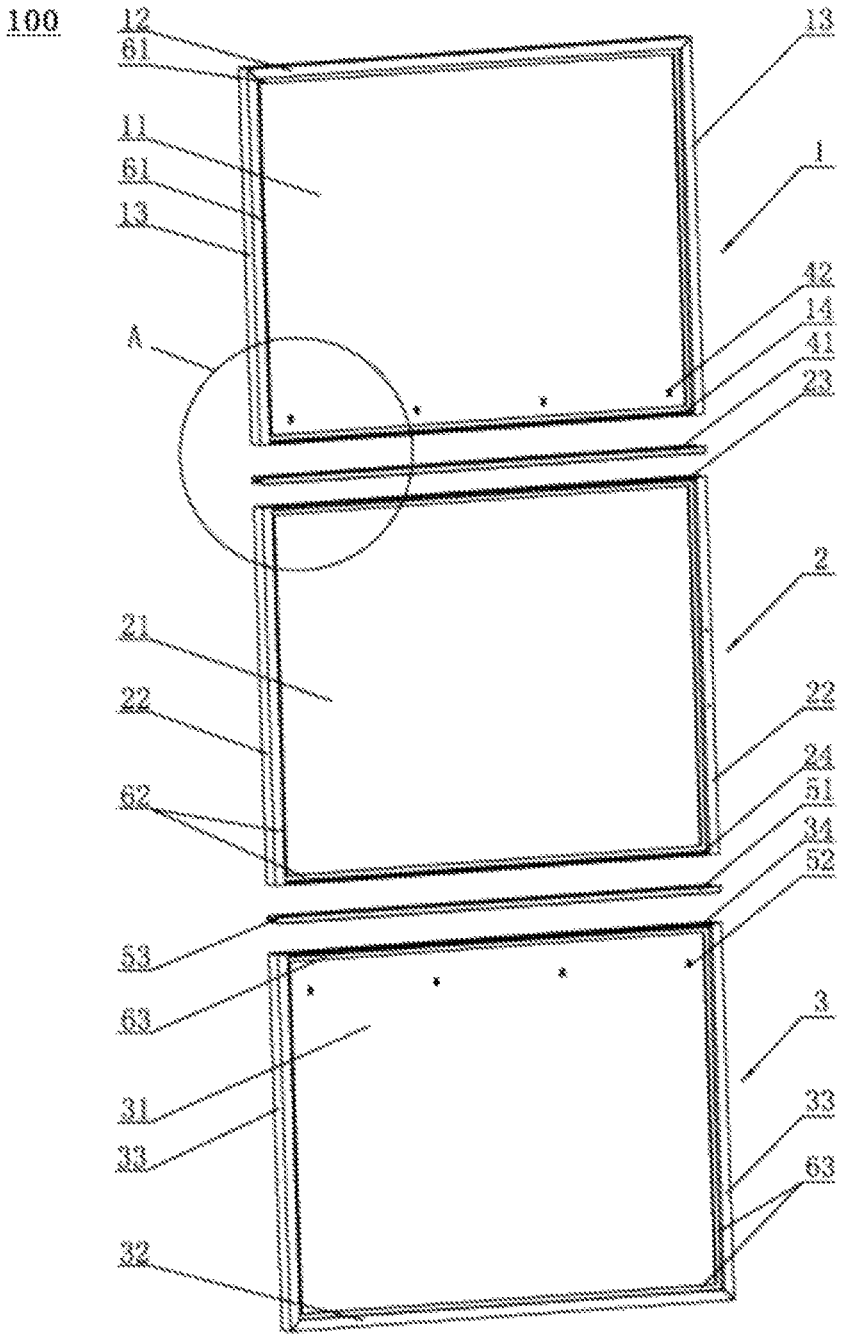
FIG. 1 is an external appearance view of an split iron frame door structure before assembling according to an embodiment of the disclosure.
Figure 2:
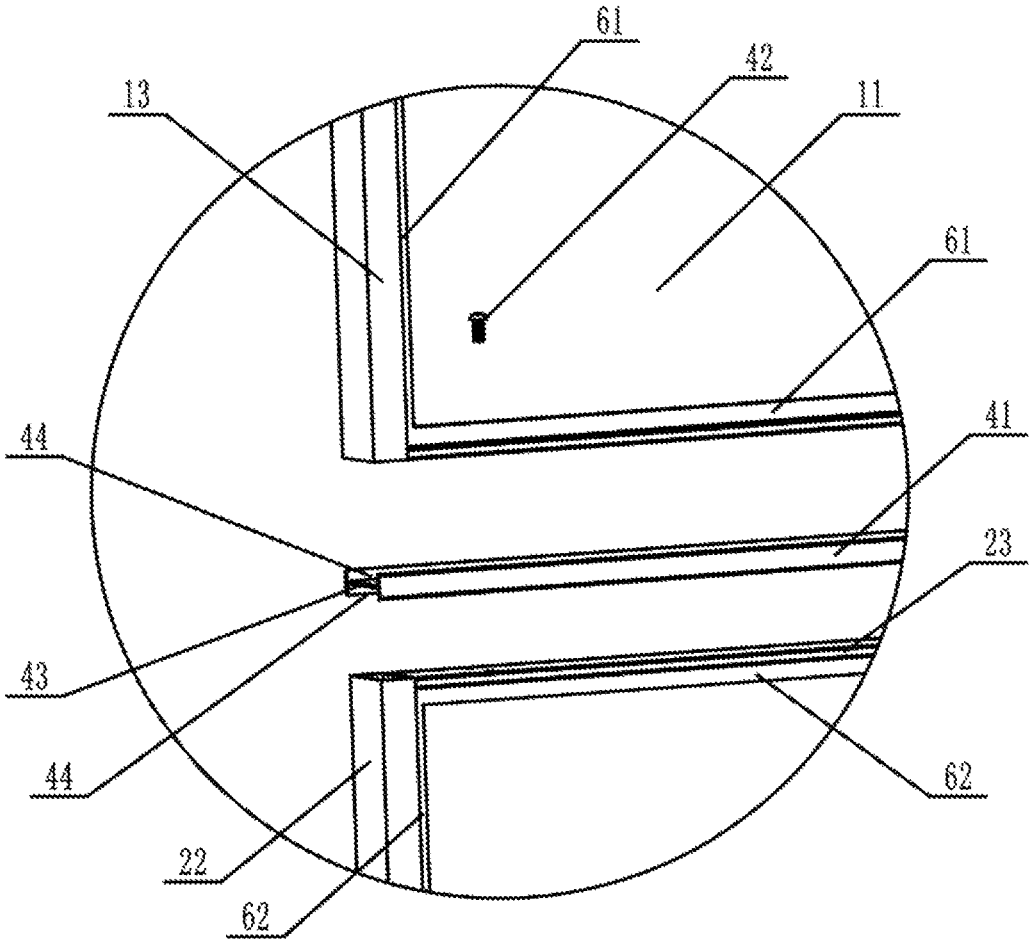
FIG. 2 is an enlarged drawing of part A in FIG. 1.
Figure 3:
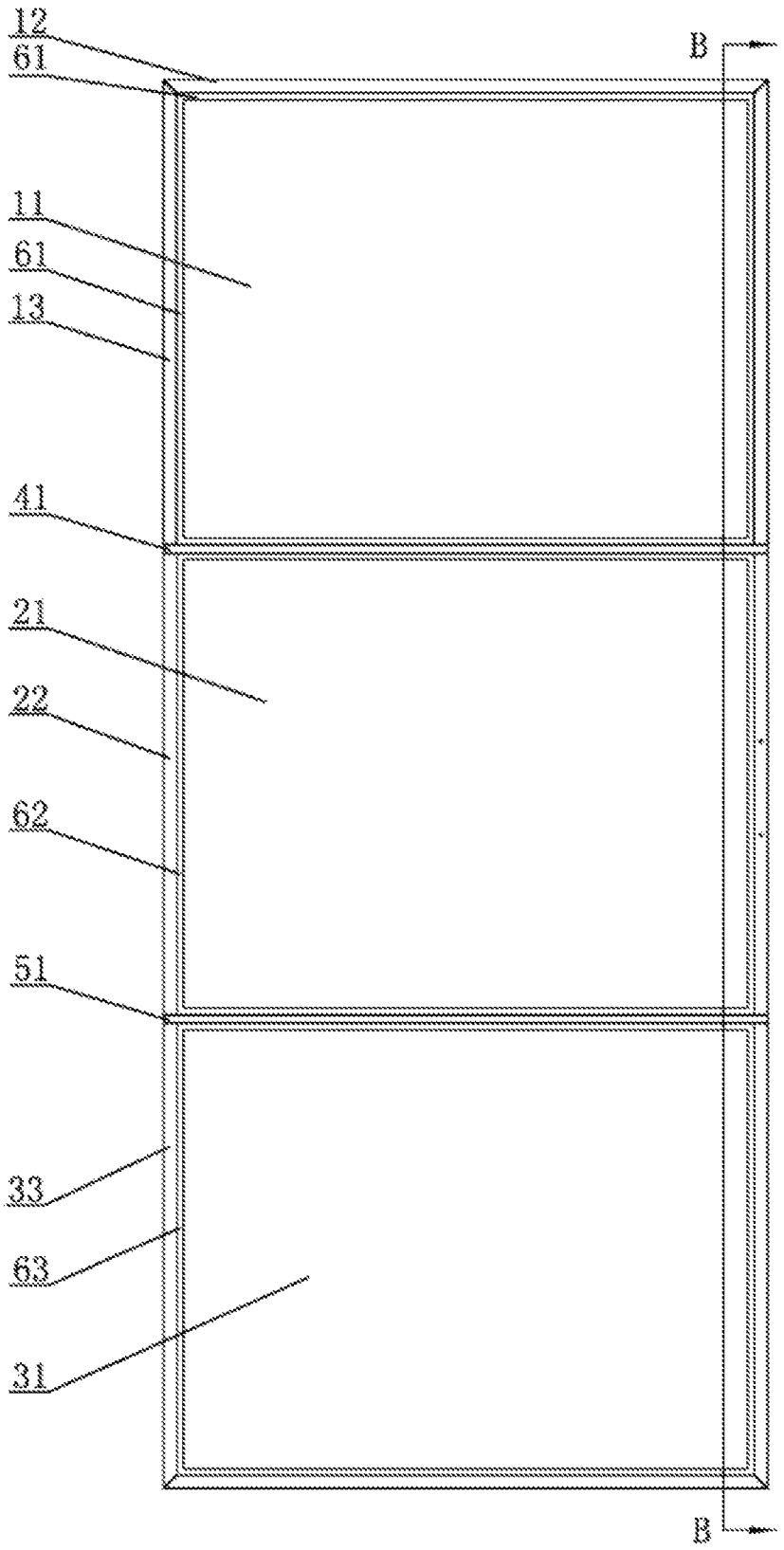
FIG. 3 is an external appearance view of the iron frame door structure after assembling according to an embodiment of the disclosure.
Figure 4:
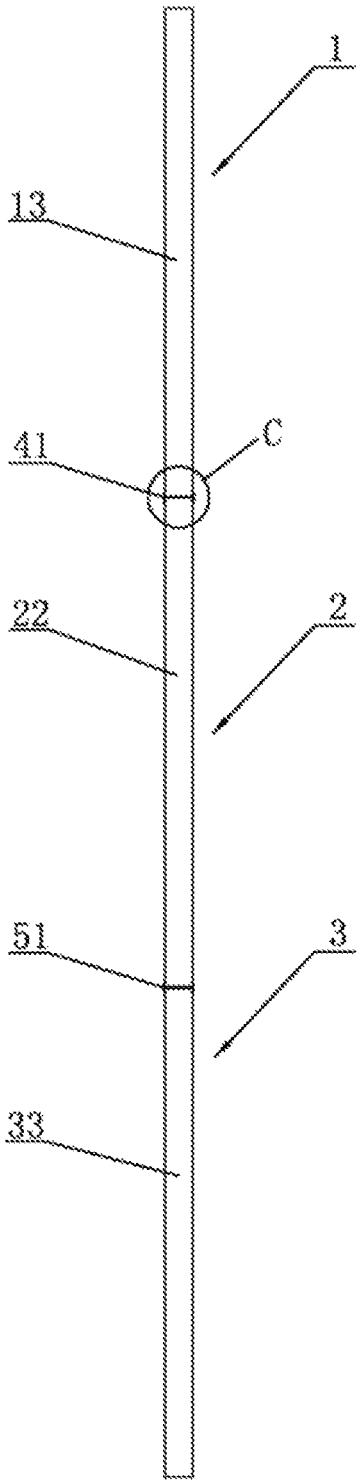
FIG. 4 is a left view of FIG. 3.
Figure 5:
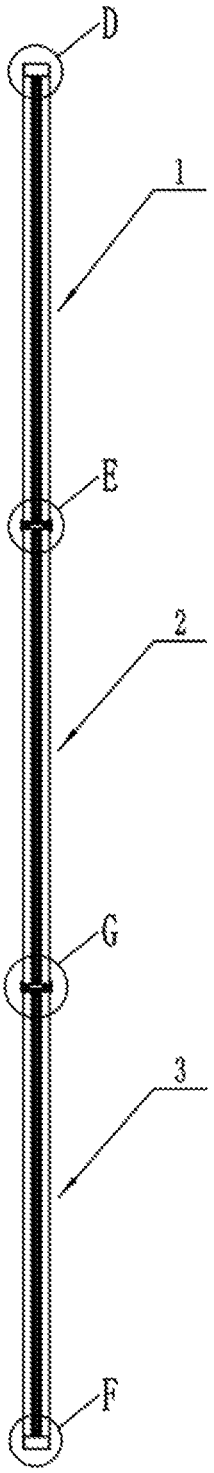
FIG. 5 is a cross-sectional view taken along line B-B in FIG. 3.
Figure 6:
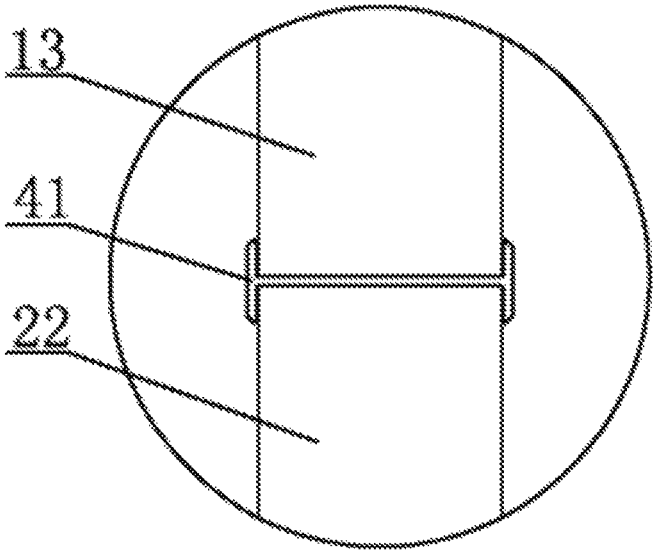
FIG. 6 is an enlarged view (first example) of part C in FIG. 4.

100, split iron frame door structure; 1, top split frame; 2, middle split frame; 3, bottom split frame; 11, top glass; 12, top edge frame; 13, first side edge frame; 14, first flat-iron edge frame; 21, middle glass; 22, second side edge frame; 23, second flat-iron edge frame; 24, third flat-iron edge frame; 25, door handle; 31, bottom glass; 32, bottom edge frame; 33, third side edge frame; 34, fourth flat-iron edge frame; 35, swing stopping device; 41, first I-shaped section material; 42, first connecting screw; 43, first middle plate; 44, notch; 44, first section material part; 45, second section material part; 431, first connecting plate; 432, third connecting plate; 441, first bent part; 442, second bent part; 443, third bent part; 444, fourth bent part; 445, fifth bent part; 446, sixth bent part; 51, second I-shaped section material; 52, second connecting screw; 53, second middle plate; 54, third section material part; 55, fourth section material part; 531, second connecting plate; 532, fourth connecting plate; 541, seventh bent part; 542, eighth bent part; 543, ninth bent part; 544, tenth bent part; 545, eleventh bent part; 546, twelfth bent part; 61, first flat-iron division bar; 62, second flat-iron division bar; 63, third flat-iron division bar, 64, first connecting part; 65, second connecting part; 71, trolley plate; 72, pulley; and 73, guide rail.

DETAILED DESCRIPTION

The following clearly and completely describes the technical scheme in the embodiments of the present disclosure with reference to the accompany drawing figures in the embodiments of the present disclosure. Apparently, the described embodiments are merely a part rather than all of the embodiments of the present disclosure. Based on the embodiment in the present disclosure, all other embodiments obtained by the ordinary technical staff in the art under the premise of without contributing creative labor belong to the scope protected by the present disclosure.

The present disclosure aims to provide a split iron frame door structure. A top split frame, a middle split frame and a bottom split frame of the split iron frame door structure can be individually packaged, the packaging cost and the transportation cost are low, and the iron frame door structure is light in overall weight, concise in appearance and good in light transmittance.

To make the foregoing objective, features and advantages of the present disclosure clearer and more comprehensible, the present disclosure is further described in detail below with reference to the attached figures and specific embodiments.

Example I

As shown in FIG. 1 to FIG. 6, the embodiment provides a split iron frame door structure 100, including a top split frame 1, a middle split frame 2 and a bottom split frame 3 which are detachably connected in sequence from top to bottom. The top split frame 1 includes two first side edge frames 13, top glass 11, and a top edge frame 12 which are connected as a whole. The middle split frame 2 includes two second side edge frames 22 and middle glass 21 which are connected as a whole. The bottom split frame 3 includes two third side edge frames 33, bottom glass 31, and a bottom edge frame 32 which are connected as a whole. The top edge frame 12 and the two first side edge frames 13 of the top split frame 1, the two second side edge frames 22 of the middle split frame 2, and the bottom edge frame 32 and the two third side edge frames 33 of the bottom split frame 3 are thin-wall square tube frames. A transversely-arranged first flat-iron edge frame 14 is fixed to the bottom of the top split frame 1. A transversely-arranged second flat-iron edge frame 23 is fixed to the top of the middle split frame 2. A transversely-arranged third flat-iron edge frame 24 is fixed to the bottom of the middle split frame 2. A transversely-arranged fourth flat-iron edge frame 34 is fixed to the top of the bottom split frame 3. The first flat-iron edge frame 14 and the second flat-iron edge frame 23 are detachably connected through a first I-shaped section material 41 and a plurality of first connecting screws 42. The first flat-iron edge frame 14 is embedded in one notch 44 of the first I-shaped section material 41, and the second flat-iron edge frame 23 is embedded in the other notch 44 of the first I-shaped section material 41. The first flat-iron edge frame 14, a first middle plate 43 of the first I-shaped section material 41 and the second flat-iron edge frame 23 are fixedly connected in sequence from top to bottom through the first connecting screws 42. The third flat-iron edge frame 24 and the fourth flat-iron edge frame 34 are detachably connected through a second I-shaped section material 51 and a plurality of second connecting screws 52. The third flat-iron edge frame 24 is embedded in one notch 44 of the second I-shaped section material 51, and the fourth flat-iron edge frame 34 is embedded in the other notch 44 of the second I-shaped section material. The third flat-iron edge frame 24, a second middle plate 53 of the second I-shaped section material and the fourth flat-iron edge frame 34 are fixedly connected in sequence from top to bottom through the second connecting screws 52.

In the example, the top split frame 1, the middle split frame 2, the bottom split frame 3, the first flat-iron edge frame 14, the second flat-iron edge frame 23, the third flat-iron edge frame 24 and the fourth flat-iron edge frame 34 are the same in width.

Example II

Figure 7:
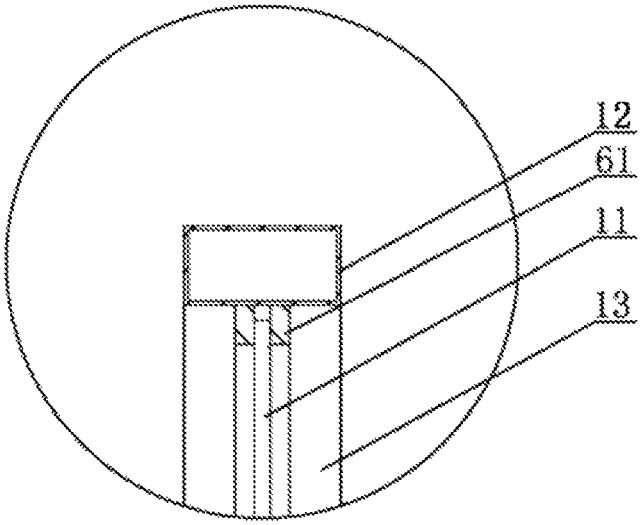
FIG. 7 is an enlarged view (second example) of part D in FIG. 5.
Figure 8:
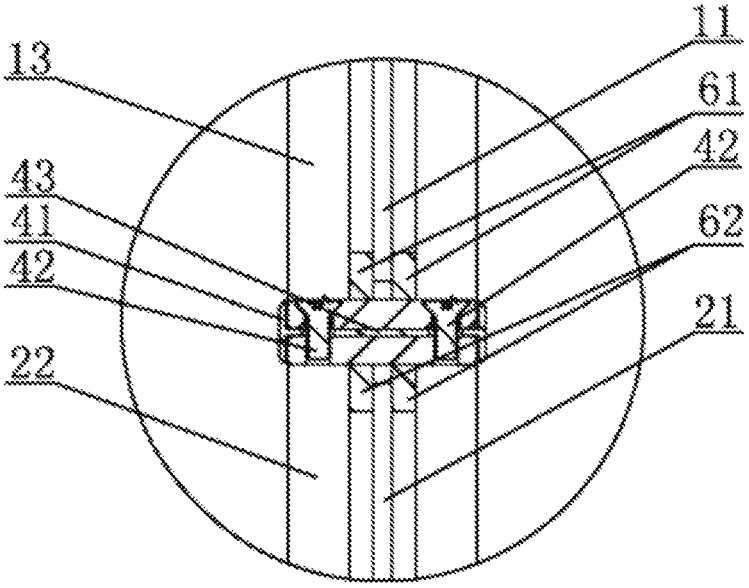
FIG. 8 is an enlarged view (second example) of part E in FIG. 5.
Figure 9:
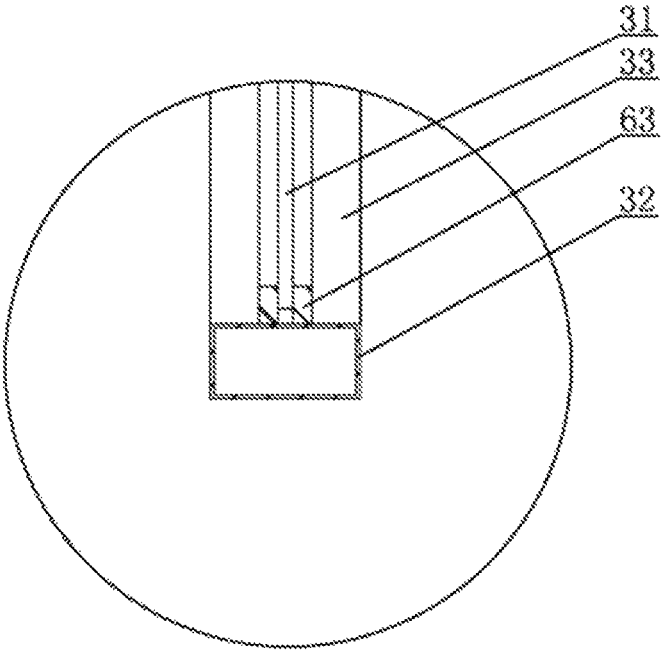
FIG. 9 is an enlarged view (second example) of part F in FIG. 5.

As shown in FIG. 7 to FIG. 9, the difference between the second example and the first example is as follows. In the second example, the top edge frame 12 and the two first side edge frames 13 of the top split frame 1 as well as the first flat-iron edge frame 14 are each fixed with two first flat-iron division bars 61, which are arranged at intervals and are configured for embedding and fixing the top glass 11. The two second side edge frames 22 of the middle split frame 2, the second flat-iron edge frame 23 and the third flat-iron edge frame 24 are each fixed with two second flat-iron division bars 62, which are arranged at intervals and configured for embedding and fixing the middle glass 21. The bottom edge frame 32 and the two third side edge frames 33 of the bottom split frame 3 as well as the fourth flat-iron edge frame 34 are each fixed with two third flat-iron division bars 63, which are arranged at intervals and configured for embedding and fixing the bottom glass 31.

Example III

Figure 10:
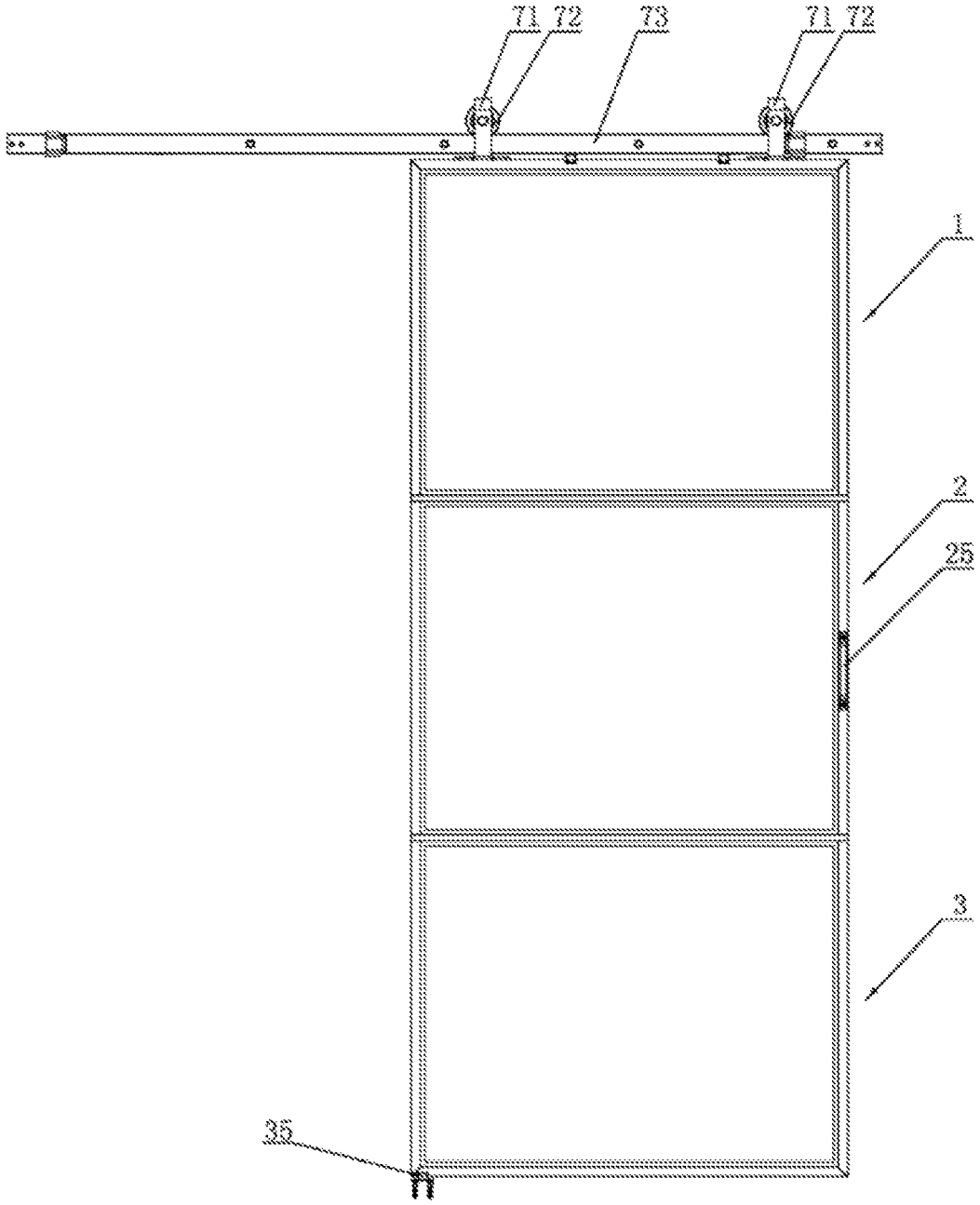
FIG. 10 is a view showing an effect of the split iron frame door structure after installing in a third example.
Figure 11:
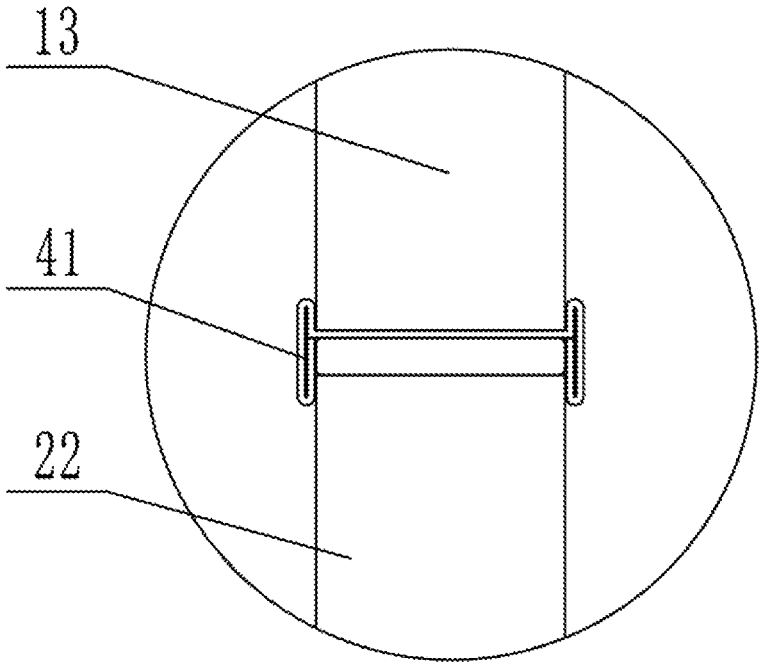
FIG. 11 is an enlarged view (Example V) of part C in FIG. 4.
Figure 12:
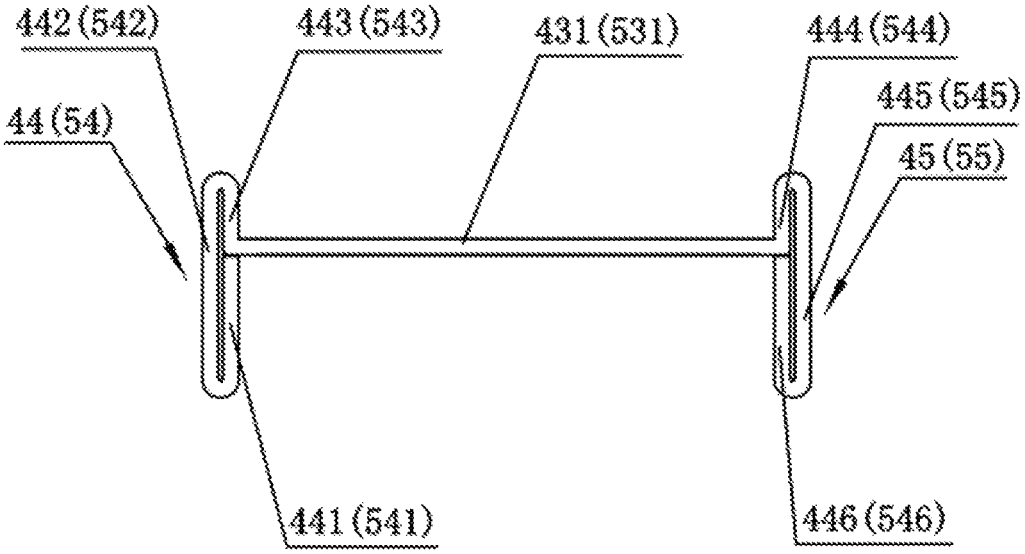
FIG. 12 is a first I-shaped section material or a schematic diagram (Example V) of the first I-shaped section material.
Figure 13:
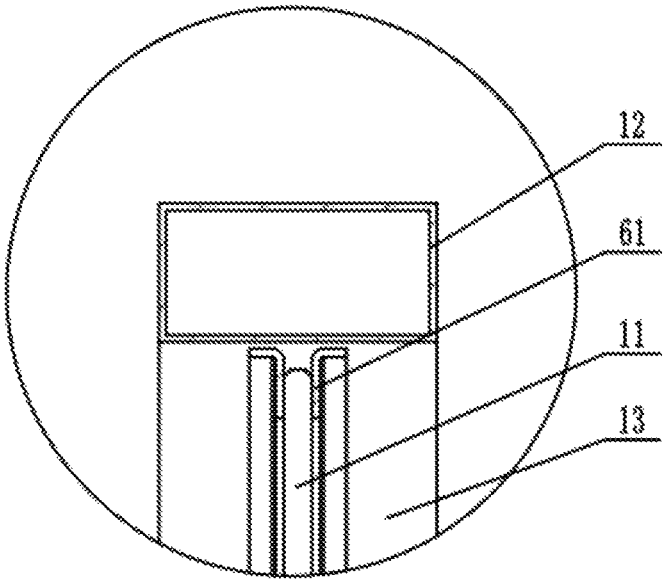
FIG. 13 is an enlarged view (Example IV) of part D in FIG. 5.
Figure 14:
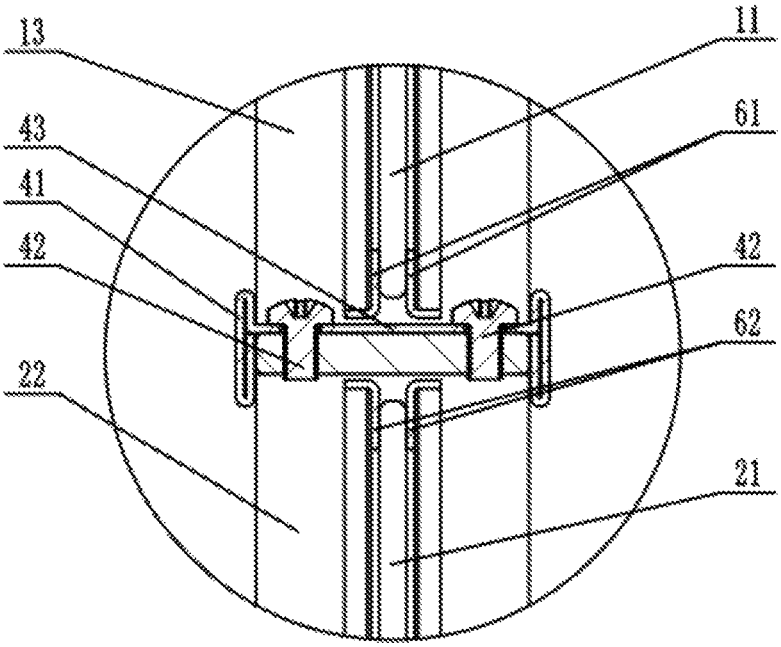
FIG. 14 is an enlarged view (Example IV and Example V) of part E in FIG. 5.
Figure 15:
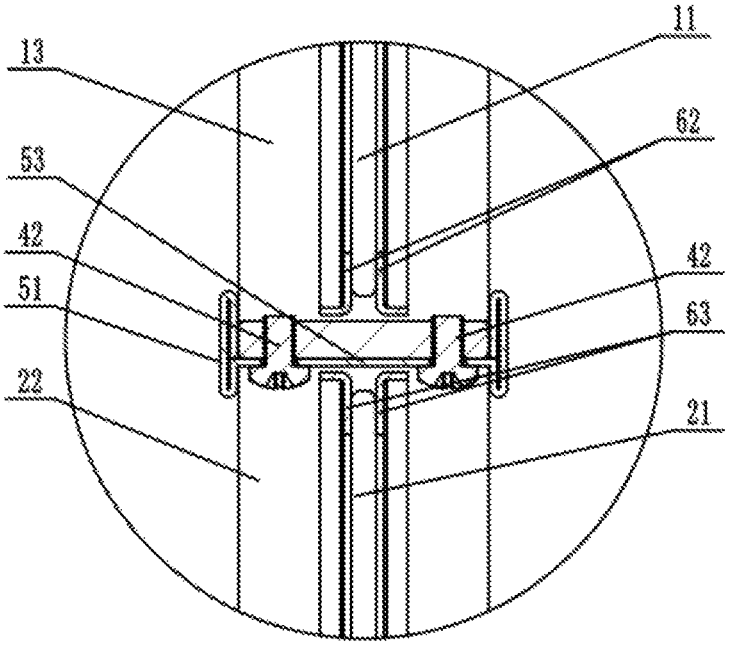
FIG. 15 is an enlarged view (Example IV and Example V) of part G in FIG. 5.
Figure 16:
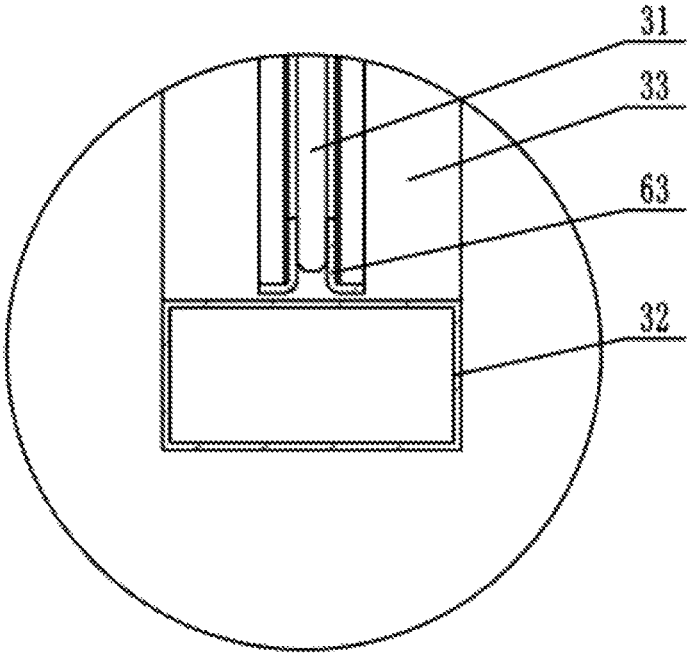
FIG. 16 is an enlarged view (Example IV) of part F in FIG. 5.
Figure 17:
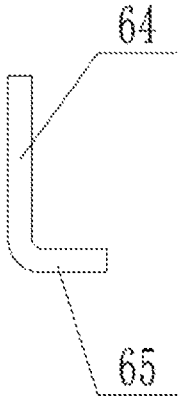
FIG. 17 is a schematic diagram (Example IV) of a bent division bar of a L-shaped structure.
Figure 18:
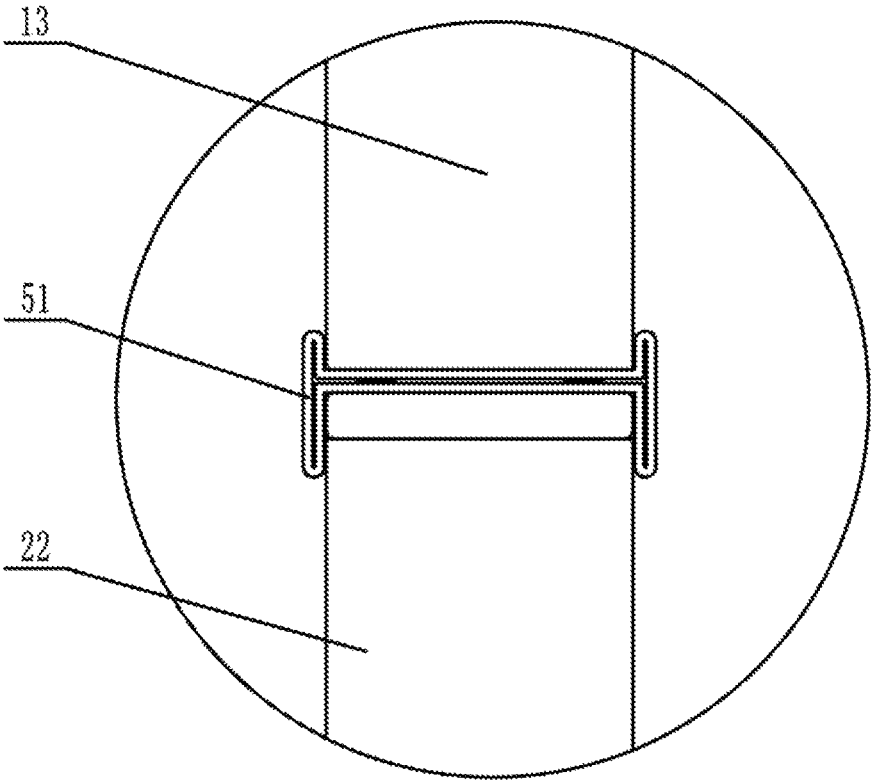
FIG. 18 is an enlarged view (Example VI) of part C in FIG. 4.
Figure 19:
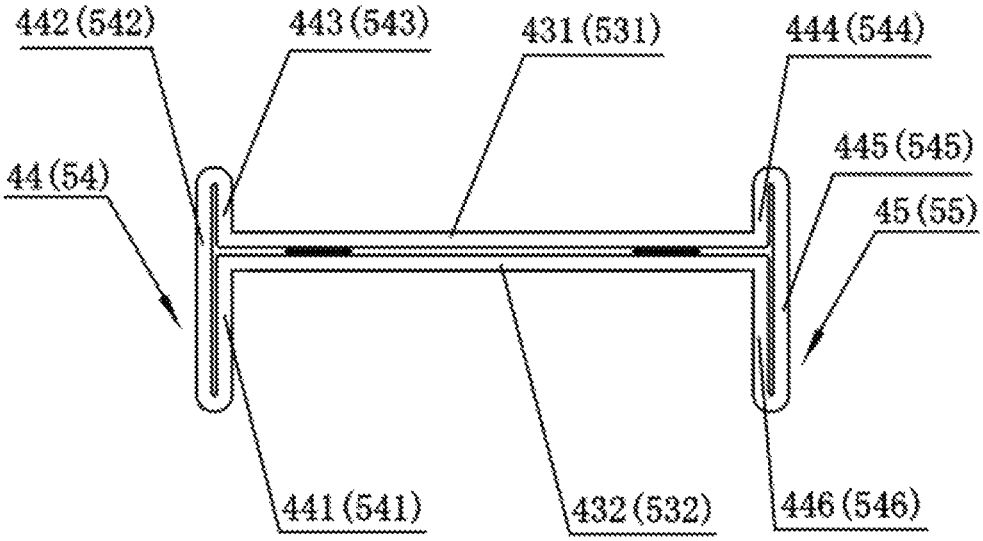
FIG. 19 is a first I-shaped section material or a schematic diagram (Example VI) of the first I-shaped section material.
Figure 20:
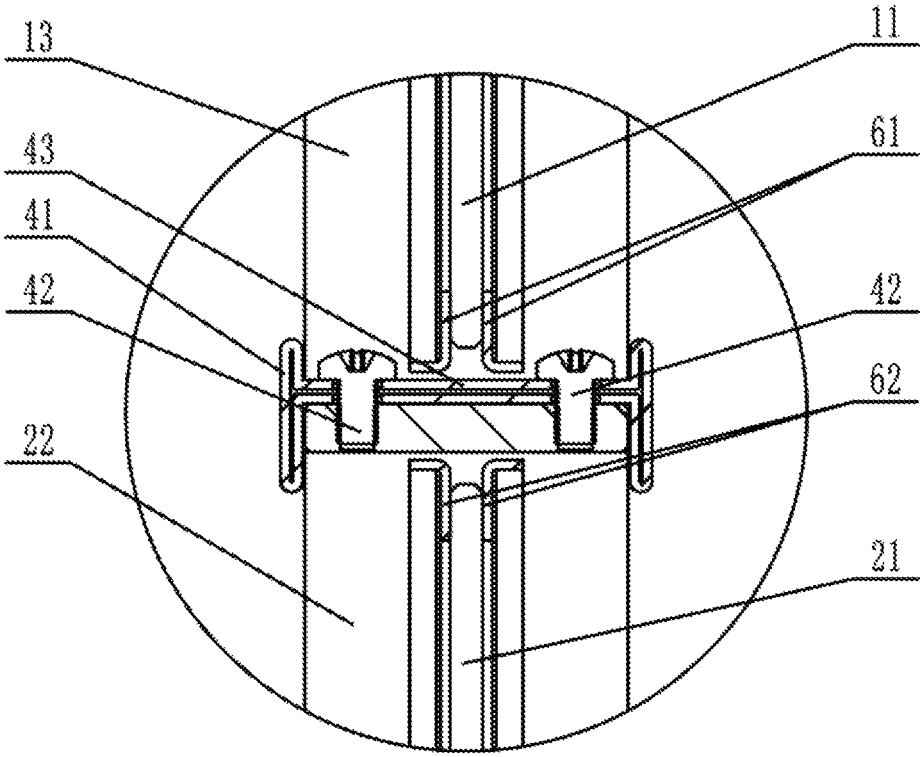
FIG. 20 is an enlarged view (Example VI) of part E in FIG. 5.
Figure 21:
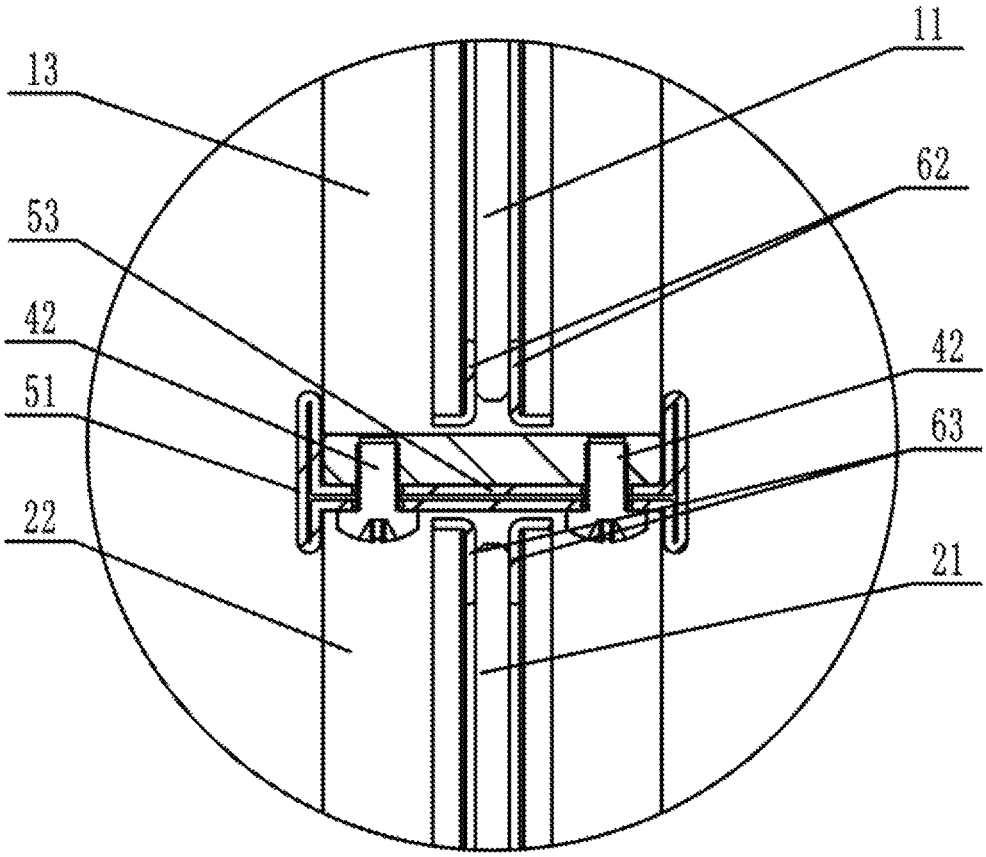
FIG. 21 is an enlarged view (Example VI) of part G in FIG. 5.

As shown in FIG. 10, the difference between the third example and the second example is as follows. In the third example, the top edge frame 12 of the top split frame 1 is fixedly connected with two trolley plates 71. Each trolley plate 71 is installed with a pulley 72. The pulley 72 is slidably erected on a guide rail 73. The guide rail 73 is fixed to a wall. A door handle 25 is installed on one of the second side edge frames 22 of the middle split frame 2. And a swing stopping device 35 is installed on the bottom edge frame 32 of the bottom split frame 3. The split iron frame door structure 100 in the third example is specifically applied to sliding door systems, and the effect after the split iron frame door structure is installed is as shown in FIG. 10.

Example IV

As shown in FIG. 13 to FIG. 17, the difference between the fourth example and the second example is as follows. In the fourth example, the first flat-iron division bars 61, the second flat-iron division bars 62 and the third flat-iron division bars 63 are all bent division bars. Each bent division bar comprises a first connecting part 64 and a second connecting part 65. And one end of first connecting part 64 is vertically arranged at one end of the corresponding second connecting part 65 to form a L-shaped structure. The bent division bars with L-shaped structures are formed by bending a galvanized sheet iron with the thickness of 1 mm by 90°. So the bent division bars are light in weight and good in stereoscopic sense.

Specifically, the first connecting parts 64 of the first flat-iron division bars 61 are in contact with the top glass 11, and the second connecting parts 65 of the first flat-iron division bars 61 are in contact with the top edge frame 12 and the first flat-iron frame 14 respectively. The first connecting parts 64 of the second flat-iron division bars 62 are in contact with the middle glass 21, and the second connecting parts 65 of the second flat-iron division bars 62 are in contact with the second flat-iron frame 23 and the third flat-iron frame 24 respectively. And the first connecting parts 64 of the third flat-iron division bars 63 are in contact with the bottom glass 31, and the second connecting parts 65 of the third flat-iron division bars 63 are in contact with the bottom frame and the fourth flat-iron frame 34 respectively.

Example V

As shown in FIG. 11 to FIG. 12 and FIG. 14 to FIG. 15, the difference between the fifth example and the first example is as follows. In the fifth example, the first I-shaped section material 41 and the second I-shaped section material 51 are the same in structure. The first I-shaped section material 41 includes a first section material part 44, a second section material part 45 and the first middle plate 43. The first section material part 44 and the second section material part 45 are symmetrically arranged at the two ends of the first middle plate 43. The first middle plate 43 is vertical to the first section material part 44 and the second section material part 45 respectively. The second I-shaped section material 51 includes a third section material part 54, a fourth section material part 55 and the second middle plate 53. The third section material part 54 and the fourth section material part 55 are symmetrically arranged at the two ends of the second middle plate 53. And the second middle plate 53 is vertical to the third section material part 54 and the fourth section material part 55 respectively.

In this example, the first middle plate 43 includes a first connecting plate 431. The first section material part 44 includes a first bent part 441, a second bent part 442 and a third bent part 443 which are connected in sequence. The second section material part 45 includes a fourth bent part 444, a fifth bent part 445 and a sixth bent part 446 which are connected in sequence. The first bent part 441, the second bent part 442, the third bent part 443, the first connecting plate 431, the fourth bent part 444, the fifth bent part 445 and the sixth bent part 446 are formed by bending a sheet material in sequence. The first I-shaped section material 41, the first bent part 441 and the sixth bent part 446 play a role in orienting the thickness direction of the middle split frame 2, and can block a gap generated after the top split frame 1 and the middle split frame 2 are spliced. So, the appearance is attractive. The third bent part 443 and the fourth bent part 444 block the first connecting screws 42, and the hiding is achieved.

The second middle plate 53 includes a second connecting plate 531. The third section material part 54 includes a seventh bent part 541, an eighth bent part 542 and a ninth bent part 543 which are connected in sequence. The fourth section material part 55 includes a tenth bent part 544, an eleventh bent part 545 and a twelfth bent part 546 which are connected in sequence. The seventh bent part 541, the eighth bent part 542, the ninth bent part 543, the second connecting plate 531, the tenth bent part 544, the eleventh bent part 545 and the twelfth bent part 546 are formed by bending a sheet material in sequence. The second I-shaped section material 51, the seventh bent part 541 and the twelfth bent part 546 play a role in orienting the thickness direction of the middle split frame 2, and can block a gap generated after the middle split frame 2 and the bottom split frame 3 are spliced. So, the appearance is attractive. The ninth bent part 543 and the tenth bent part 544 block the second connecting screws 52, and the hiding is achieved.

In the example, the first middle plate 43 and the second middle plate 53 are both of single-sheet structures.

Example VI

As shown in FIG. 18 to FIG. 21, the difference between the sixth example and the fifth example is as follows. In the sixth example, the first middle plate 43 includes a first connecting plate 431 and a third connecting plate 432 which are arranged in parallel. The first connecting plate 431 and the third connecting plate 432 are formed by rolling. The first sectional material part 44 includes a first bent part 441, a second bent part 442 and a third bent part 443 which are connected in sequence. The second section material part 45 includes a fourth bent part 444, a fifth bent part 445 and a sixth bent part 446 which are connected in sequence. The first bent part 441, the second bent part 442, the third bent part 443, the first connecting plate 431, the fourth bent part 444, the fifth bent part 445 and the sixth bent part 446 are formed by bending a sheet material in sequence. One end of the third connecting plate 432 is connected with one end of the first bent part 441, and the other end of the third connecting plate 432 is connected with one end of the sixth bent part 446.

The second middle plate 53 includes a second connecting plate 531 and a fourth connecting plate 532 which are arranged in parallel. The second connecting plate 531 and the fourth connecting plate 532 are formed by rolling. The third section material part 54 includes a seventh bent part 541, an eighth bent part 542 and a ninth bent part 543 which are connected in sequence. The fourth section material part 55 includes a tenth bent part 544, an eleventh bent part 545 and a twelfth bent part 546 which are connected in sequence. The seventh bent part 541, the eighth bent part 542, the ninth bent part 543, the second connecting plate 531, the tenth bent part 544, the eleventh bent part 545 and the twelfth bent part 546 are formed by bending a sheet material in sequence. One end of the fourth connecting plate 532 is connected with one end of the seventh bent part 541, and the other end of the fourth connecting plate 532 is connected with one end of the twelfth bent part 546.

In the example, the first middle plate 43 and the second middle plate 53 are both of single-sheet structures. According to the use intensity, the fifth example and the sixth example can be selected.

Example VII

The difference between the seventh example and the first example is as follows. In the seventh example, the first connecting screws 42 and the second connecting screws 52 are all pan head screws with cross recess.

Several examples are used for illustration of the principles and implementation methods of the present disclosure. The description of the embodiments is used to help illustrate the method and the core principles of the present disclosure; and meanwhile, those skilled in the art can make various modifications in terms of specific embodiments and scope of application in accordance with the teachings of the present disclosure. In conclusion, the content of this specification shall not be construed as a limitation to the present disclosure.

What is claimed is:

1. A split iron frame door structure, comprising:

a top split frame, a middle split frame and a bottom split frame which are detachably connected in sequence from top to bottom, wherein the top split frame comprises two first side edge frames, top glass, and a top edge frame which are connected as a whole;

the middle split frame comprises two second side edge frames and middle glass which are connected as a whole;

the bottom split frame comprises two third side edge frames, bottom glass, and a bottom edge frame which are connected as a whole;

the top edge frame and the two first side edge frames of the top split frame, the two second side edge frames of the middle split frame and the bottom edge frame and the two third side edge frames of the bottom split frame are thin-wall square tube frames;

a bottom of the top split frame is fixed with a transversely-arranged first flat-iron edge frame;

a top of the middle split frame is fixed with a transversely-arranged second flat-iron edge frame;

a bottom of the middle split frame is fixed with a transversely-arranged third flat-iron edge frame;

a top of the bottom split frame is fixed with a transversely-arranged fourth flat-iron edge frame;

the first flat-iron edge frame and the second flat-iron edge frame are detachably connected through a first I-shaped section material and a plurality of first connecting screws;

the first flat-iron edge frame is embedded in one notch of the first I-shaped section material;

the second flat-iron edge frame is embedded in an other notch of the first I-shaped section material;

the first flat-iron edge frame, a first middle plate of the first I-shaped section material and the second flat-iron edge frame are fixedly connected in sequence from top to bottom through the first connecting screws;

the third flat-iron edge frame and the fourth flat-iron edge frame are detachably connected through a second I-shaped section material and a plurality of second connecting screws;

the third flat-iron edge frame is embedded in one notch of the second I-shaped section material;

the fourth flat-iron edge frame is embedded in an other notch of the second I-shaped section material;

the third flat-iron edge frame, a second middle plate of the second I-shaped section material and the fourth flat-iron edge frame are fixedly connected in sequence from top to bottom through the second connecting screws; and the top edge frame and the two first side edge frames of the top split frame as well as the first flat-iron edge frame are each fixed with two first flat-iron division bars, which are arranged at intervals and are configured for embedding and fixing the top glass; the two second side edge frames of the middle split frame, the second flat-iron edge frame and the third flat-iron edge frame are each fixed with two second flat-iron division bars, which are arranged at intervals and configured for embedding and fixing the middle glass; and the bottom edge frame and the two third side edge frames of the bottom split frame as well as the fourth flat-iron edge frame are each fixed with two third flat-iron division bars, which are arranged at intervals and configured for embedding and fixing the bottom glass.

2. The split iron frame door structure according to claim 1, wherein the top split frame, the middle split frame, the bottom split frame, the first flat-iron edge frame, the second flat-iron edge frame, the third flat-iron edge frame and the fourth flat-iron edge frame have same widths.

3. The split iron frame door structure according to claim 1, wherein the top edge frame of the top split frame is fixedly connected with two trolley plates; a pulley is installed on each of the two trolley plates; the pulley is slidably erected on a guide rail fixed to a wall; one of the second side edge frames of the middle split frame is installed with a door handle; and the bottom edge frame of the bottom split frame is installed with a swing stopping device.

4. The split iron frame door structure according to claim 1, wherein the first I-shaped section material comprises a first section material part, a second section material part and the first middle plate;

the first section material part and the second section material part are symmetrically arranged at two ends of the first middle plate;

the first middle plate is vertical to the first section material part and the second section material part respectively;

the second I-shaped section material comprises a third section material part, a fourth section material part and the second middle plate;

the third section material part and the fourth section material part are symmetrically arranged at two ends of the second middle plate; and the second middle plate is vertical to the third section material part and the fourth section material part respectively.

5. The split iron frame door structure according to claim 4, wherein the first middle plate comprises a first connecting plate; the first section material part comprises a first bent part, a second bent part and a third bent part which are connected in sequence; the second section material part comprises a fourth bent part, a fifth bent part and a sixth bent part which are connected in sequence; and the first bent part, the second bent part, the third bent part, the first connecting plate, the fourth bent part, the fifth bent part and the sixth bent part are bent in sequence to form the first I-shaped section material;

the second middle plate comprises a second connecting plate; the third section material part comprises a seventh bent part, an eighth bent part and a ninth bent part which are connected in sequence; the fourth section material part comprises a tenth bent part, an eleventh bent part and a twelfth bent part which are connected in sequence; and the seventh bent part, the eighth bent part, the ninth bent part, the second connecting plate, the tenth bent part, the eleventh bent part and the twelfth bent part are bent in sequence to form the second I-shaped section material.

6. The split iron frame door structure according to claim 4, wherein the first middle plate comprises a first connecting plate and a third connecting plate which are arranged in parallel; the first section material part comprises a first bent part, a second bent part and a third bent part which are connected in sequence; the second section material part comprises a fourth bent part, a fifth bent part and a sixth bent part which are connected in sequence; the first bent part, the second bent part, the third bent part, the first connecting plate, the fourth bent part, the fifth bent part and the sixth bent part are bent in sequence; one end of the third connecting plate is connected with one end of the first bent part; and an other end of the third connecting plate is connected with one end of the sixth bent part;

the second middle plate comprises a second connecting plate and a fourth connecting plate which are arranged in parallel; the third section material part comprises a seventh bent part, an eighth bent part and a ninth bent part which are connected in sequence; the fourth section material part comprises a tenth bent part, an eleventh bent part and a twelfth bent part which are connected in sequence; the seventh bent part, the eighth bent part, the ninth bent part, the second connecting plate, the tenth bent part, the eleventh bent part and the twelfth bent part are bent in sequence; one end of the fourth connecting plate is connected with one end of the seventh bent part; and an other end of the fourth connecting plate is connected with one end of the twelfth bent part.

7. The split iron frame door structure according to claim 1, wherein the first connecting screws and the second connecting screws are pan head screws with cross recess.

8. The split iron frame door structure according to claim 1, wherein the two first flat-iron division bars, the two second flat-iron division bars and the two third flat-iron division bars are bent division bars; each of the bent division bars comprises a first connecting part and a second connecting part; and one end of the first connecting part is vertically arranged at one end of the second connecting part to form an L-shaped structure.

* * * * *